US005598614A

United States Patent [19]

Bianco

[11] Patent Number: 5,598,614

[45] Date of Patent: Feb. 4, 1997

[54] DEVICE FOR CENTERING A TUBULAR FABRIC

[75] Inventor: Mario Bianco, Alba, Italy

[73] Assignee: Bianco S.p.A., Italy

[21] Appl. No.: 519,079

[22] Filed: Aug. 24, 1995

[30] Foreign Application Priority Data

Oct. 21, 1994 [IT] Italy ..... TO94A0815

[51] Int. Cl.[6] ..... D06C 5/00

[52] U.S. Cl. ..... 26/82; 26/84; 26/85; 26/51.5

[58] Field of Search ..... 26/80, 83, 84, 26/85, 82, 51.5, 72, 75, 77, 74

[56] References Cited

U.S. PATENT DOCUMENTS

| | | | |
|---|---|---|---|
| 1,775,894 | 9/1930 | Drabble | 26/83 |
| 2,110,520 | 3/1938 | Cunnius | 26/83 |
| 2,294,642 | 9/1942 | Wedler | 26/85 |
| 2,339,151 | 1/1944 | Cohn et al. | 26/83 |
| 2,534,015 | 12/1950 | Gerstein et al. | 26/80 |
| 2,668,324 | 2/1954 | Johnson | 26/80 |
| 2,781,589 | 2/1957 | Cornwell | 26/83 |
| 2,894,106 | 7/1959 | Jacob et al. | 219/29 |
| 3,332,124 | 7/1967 | Beard | 26/83 |
| 3,381,397 | 5/1968 | Cohn et al. | 26/82 |
| 3,616,502 | 11/1971 | Arnoff | 26/85 |
| 4,017,722 | 4/1977 | Swanson | 26/51.5 |
| 4,305,184 | 12/1981 | Woythal | 26/51.5 |
| 5,233,734 | 8/1993 | Strudel et al. | 26/80 |

FOREIGN PATENT DOCUMENTS

| | | |
|---|---|---|
| 0603645 | 6/1994 | European Pat. Off. . |
| 2130721 | 6/1971 | Germany . |
| 2015239 | 10/1971 | Germany . |
| 2254371 | 11/1972 | Germany . |
| 2064609 | 6/1981 | United Kingdom . |
| 2070660 | 9/1981 | United Kingdom . |

*Primary Examiner*—Amy B. Vanatta

*Attorney, Agent, or Firm*—Merchant, Gould, Smith, Edell, Welter and Schmidt

[57] ABSTRACT

A device (15) for centering a tubular fabric (10) comprises a central fixed supporting portion (16) located within the fabric. A pair of oscillating arms (17) each having an end mounted to said central fixed portion (16), are kept divaricated against the tubular fabric. A motor driven roller unit (18) is secured to the free end of each oscillating arm (17) and has an electric motor (19). Motors (19) control rotation, in the same direction of rotation, of respective supporting members (21) each fitted with a plurality of idle rollers (22). The rollers (22) are angularly equally spaced around their respective supporting member (21) and are free to rotate about respective axes of rotation transverse to the direction of advancement of the fabric. Rotation of supporting members (21) in the same direction causes the fabric to rotate, while oscillating arms (17) keep the fabric stretched.

6 Claims, 3 Drawing Sheets

DEVICE FOR CENTERING A TUBULAR FABRIC

FIELD OF THE INVENTION

The present invention falls within the field of textile equipment for untwisting, widening and cutting tubular fabric. More particularly, the invention relates to a device for centering a tubular fabric.

BACKGROUND OF THE INVENTION

As known, tubular fabric usually comes out in rope-like form after dyeing operations. Firstly, the fabric needs to be untwisted, and then has to be widened transversally so as to carry out successive lengthwise cutting, opening and spreading operations.

Cutting is attained along the line determined by a missing weft. The position of such a line is continuously sensed by suitable reading means that are associated with a device for centering the fabric. Depending on the direction and displacement of the missing weft line relative to the central position, as sensed by the reading means, the centering device rotates the tubular fabric in either direction so as to get the missing weft line to face the cutting device precisely.

Besides accuracy, a basic requirement of the centering device is that it must be able to work at high speed. Rotation and counter-rotation must occur very quickly, not to limit the speed of advancement of the fabric. The fabric must necessarily be stretched to be able to react promptly to the stresses it is subjected to by the centering device. Also, wrinkles and overlapping of the fabric can be prejudicial to the accuracy with which the missing weft line is positioned, thereby compromising correct lengthwise cutting of the fabric.

There are known centering devices provided with idly mounted rollers that do not hinder lengthwise advancement of the fabric. By rotating transversally relative to the direction of advancement of the fabric, the rollers cause the fabric to rotate for centering the missing weft line on the cutting tool. However, conventional centering devices do not work on a stretched fabric. As a result, they are not capable of attaining required corrections of position quickly enough and therefore represent a "slow" point of the textile plant.

SUMMARY OF THE INVENTION

It is an object of the present invention to provide a centering device capable of overcoming the above prior art drawbacks. Particularly, it is an object of the present invention to provide a device capable of giving the fabric the necessary tension to let it react as quickly as possible to stresses it is subjected to, in order to reset the fabric's position immediately and allow the entire section to work at higher speed.

In accordance with one aspect of the invention as claimed, these objects are accomplished by the provision of a device for centering a tubular fabric, of the type comprising two groups of rollers idly mounted on axes transverse with respect to a given direction of advancement of the fabric and carried by respective motor driven roller units controlled by photoelectric cell means positioned along the path of the tubular fabric upstream of cutting means for cutting the fabric lengthwise. Said motor driven roller units are controlled for moving the two groups of rollers sideways relative to their planes of rotation and rotating the fabric about an axis substantially parallel to said given direction. The device is characterized in that it comprises stretching means adapted for stretching the tubular fabric transverse to said given direction. Said stretching means are operatively associated with said motor driven roller units supporting said groups of rollers.

BRIEF DESCRIPTION OF THE DRAWINGS

In order that the present invention may be well understood there will now be described a few preferred embodiments thereof, given by way of example, reference being made to the accompanying drawings, in which.

DETAILED DESCRIPTION OF PREFERRED EMBODIMENTS

Figure 2:
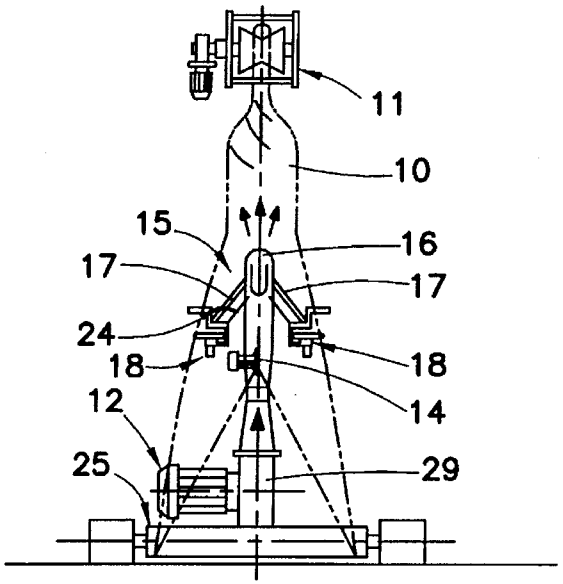
FIG. 2 is a front view of the apparatus of FIG, 1.
Figure 4:
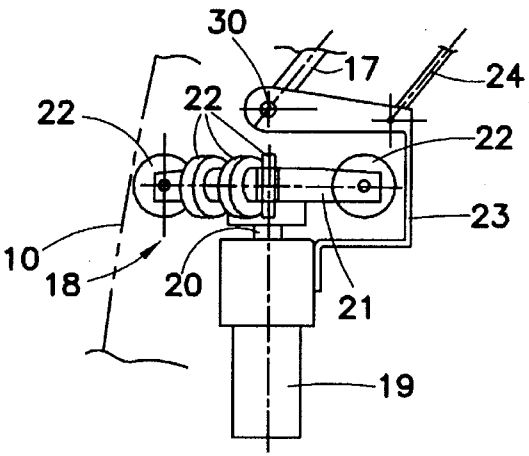
FIG. 4 is a view, to an enlarged scale, of a detail of the device of this invention shown in FIG. 2.
Figure 1:
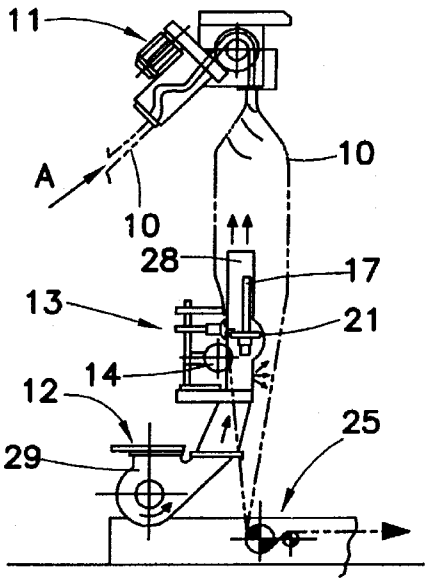
FIG. 1 is a side view of an apparatus for untwisting, widening and cutting tubular fabrics; the apparatus includes a centering device according to the present invention.
Figure 3:
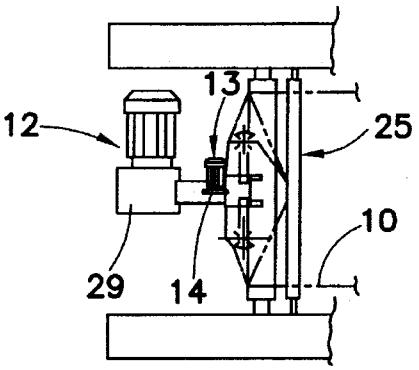
FIG. 3 is a plan view of the apparatus of FIG. 1.

With reference initially to FIGS. 1 and 2, there is shown an apparatus for carrying out continuously a series of operations on a tubular fabric 10 advancing therethrough. Numeral 11 designates a straightening equipment for untwisting the fabric arriving in rope-like form. Direction of advancement is indicated by arrow A (FIG. 1). The straightening equipment 11, being of known kind, is not hereinafter described in detail. Untwisting equipment 11 rotates the fabric in rope-like form, as it is after dyeing, in the two opposite directions with respect to its direction of advancement, in order to provide a substantially untwisted fabric ready for widening, lengthwise cutting and tentering.

The fabric 10 coming out of the straightening equipment is widened. In the preferred-embodiment shown in the drawings, the fabric is widened by inflating it with an air blow. Air is inflated counter-current within the tubular fabric by means of a conventional widening device 12 composed of a power fan 29 delivering air into the tubular fabric through a conduit 28 open at one end. In this inflated condition, the tubular fabric arrives to a cutting unit. Generally, cutting unit 13 employs a vertical rotating disc 14 to cut the fabric lengthwise along a line determined by a missing weft.

Within the tubular fabric, immediately upstream or above cutting unit 13, there is installed a fabric centering device, designated overall by numeral 15. Centering device 15 rotates the inflated fabric in the two opposite directions about an axis parallel to the direction of advancement with an aim to keep the line of the missing weft continuously centered on cutting unit 13.

The centering unit 15 is operatively coupled to a reading assembly, preferably of optical kind. The reading assembly senses continuously the position of the missing weft line.

Should this line be displaced with respect to the ideal line where it should be, the reading assembly informs the centering device so that this may be immediately activated to center the tubular fabric.

According to the present invention, the centering device 15 comprises a central supporting fixed portion 16 to which a pair of oscillating arms 17 is mounted. At the free end, each oscillating arm 17 is fitted with a motor driven roller unit 18. Each roller unit 18 has an electric motor 19 having an output shaft 20 rotating a substantially annular-shaped supporting member 21 about an axis substantially parallel to the direction of advancement of the fabric. Mounted to supporting member 21 is a plurality of idle wheels or rollers 22 having axes of rotation substantially horizontal or transversal with respect to the direction of advancement of the fabric.

In the preferred embodiment illustrated, the idle rollers 22 are preferably angularly equally spaced around the axis of shaft 20. In addition, the supporting member 21 illustrated is of annular shape, but it may also take other shapes, such as a polygonal arrangement, to perform its function of supporting and distancing the rollers.

By being rotated in a same direction by motors 19, the two supporting members 21 cause the rollers to exert some friction on the surrounding fabric, thereby rotating it in the desired direction of rotation, transverse with respect to the direction of advancement. Being idle, the rollers 22 exert no friction or almost no friction on the fabric 10 moving vertically. Therefore, the fabric can keep its vertical speed.

Each motor driven roller unit 18 is hinged at 30 to an end portion of the respective oscillating arm 17 through a connecting bracket 23. Bracket 23 is also connected to an end of an elastic member 24, the opposite end of which is secured to the central supporting fixed portion 16. The function of elastic members 24 is to resiliently divaricate the two oscillating arms for keeping the fabric stretched so that it can be rotated quickly and be arrive in a centered arrangement to the successive workstations for cutting, tentering, etc. Also, elastic members 24 adjust the angle of arms 17 to tubular fabrics of any size without generating lateral stresses therein.

Figure 6:
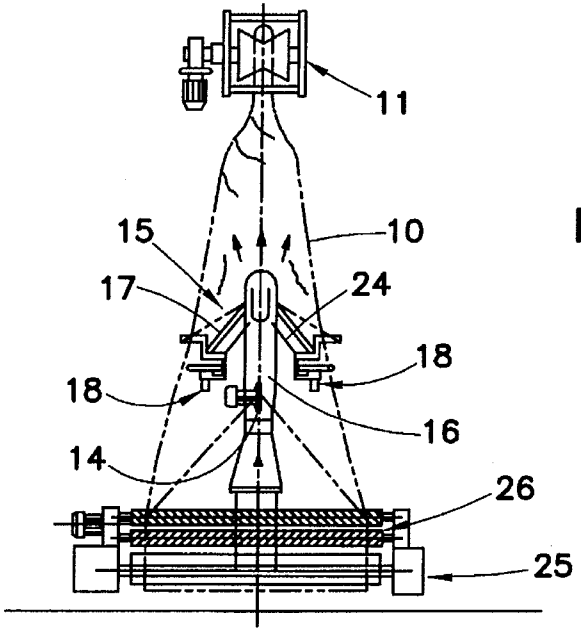
FIGS. 6 and 7 show a front and a plan view of the apparatus of FIG. 5, respectively.
Figure 5:
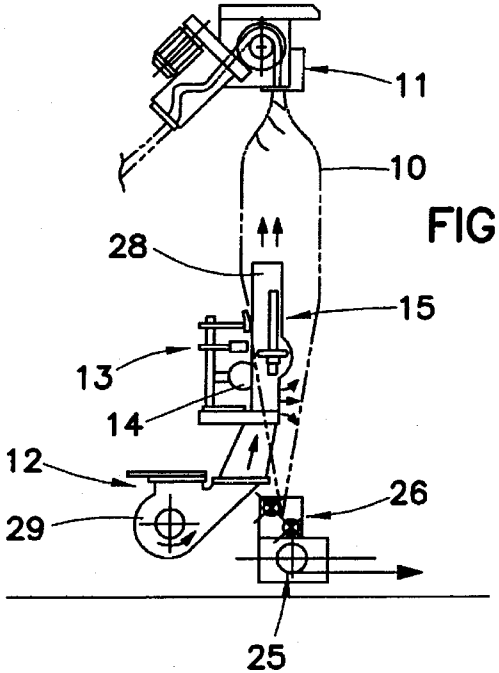
FIG. 5 is a side view of an apparatus for working tubular fabrics different from the apparatus of FIGS. 1 to 3 but still incorporating a centering device of this invention.
Figure 7:
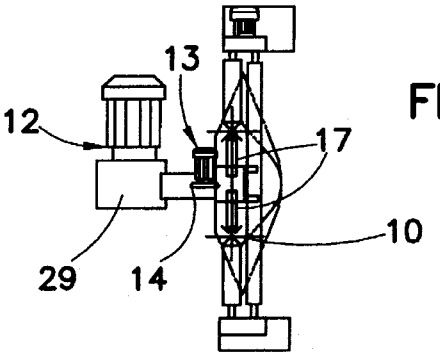
Figure 9:
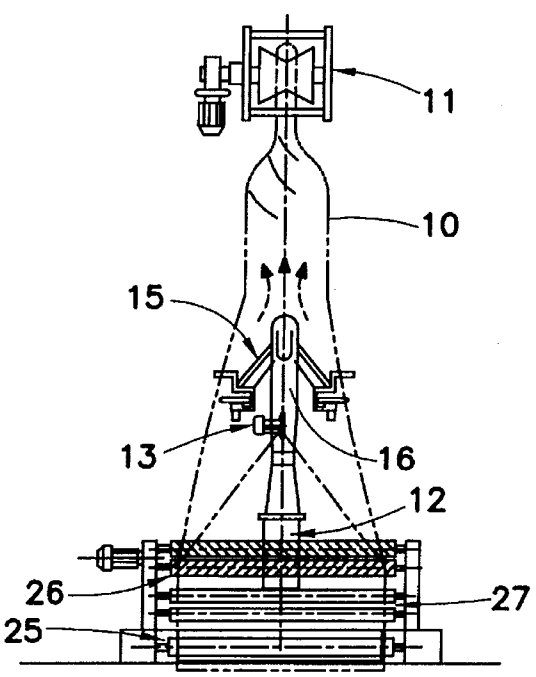
FIGS. 9 and 10 show a front and a plan view of the apparatus of FIG. 8, respectively.
Figure 8:
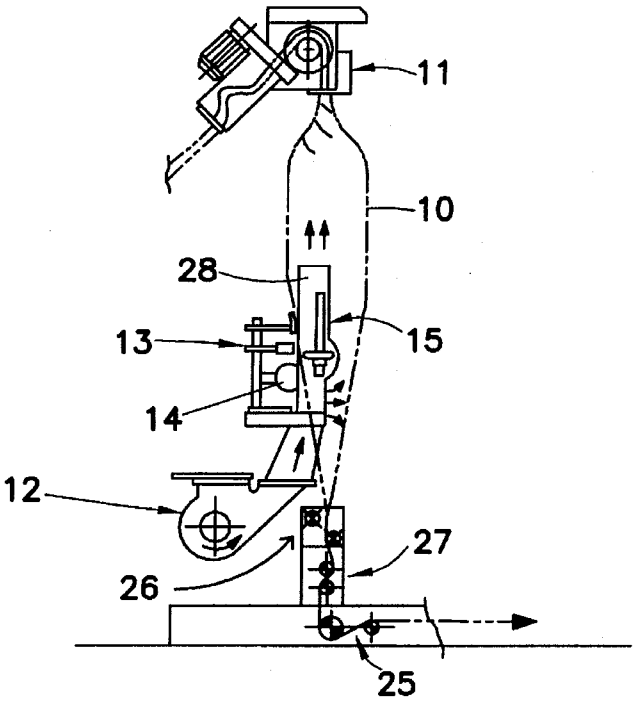
FIG. 8 is a side view of another apparatus for working tubular fabrics still different from the apparatus of FIGS. 1 to 7 but still incorporating a centering device of this invention.
Figure 10:
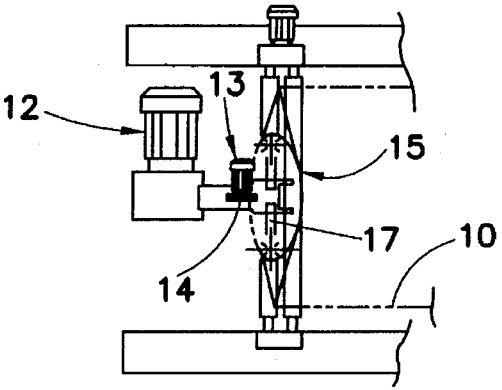

After cutting and tentering, the fabric 10 normally passes through a driving unit 25 (FIGS. 1 and 2) to be subjected to further operations or simply stored. FIGS. 5 and 6 show the case where the centering device 15 according to the present invention is installed in a processing plant comprising a widening and centering unit 26 fitted with spiral surface rollers located immediately upstream of the final driving unit 25. In FIGS. 8 and 9, an widening equipment using a suspended roller device 27 is interposed between the widening and centering device 26 and the final driving unit 25.

As will be apparent, the centering device 15 of the present invention is completely inserted within the tubular fabric. The fabric is not only spread out by the air being blown in, but it is also stretched by the centering device itself. As a result, it is possible to transmit quicker centering rotary motion to the fabric. The great advantage is that the fabric is allowed o travel much more rapidly in comparison to conventional centering devices. As the fabric is properly widened and stretched, stresses caused by friction that normally occur as the fabric advances within the equipment are considerably reduced.

Moreover, the oscillating arms divaricate and adjust immediately and automatically to the tubular fabric's diameter, whereby the centering device 15 is adapted to work with tubular fabrics having different diameter.

Another advantage concerning the fact that the tubular fabric is widened and stretched is an improvement in the response of the twist sensing device incorporated in the straightening assembly. As set forth, the tubular fabric is kept very wide by the device of this invention (and the air blow coming from below); consequently, the length of fabric still twisted in ripe-like form leaving the straightening unit is minor as in comparison with prior art. Therefore, the effect of the straightening unit will be more efficient, having to eliminate twist on a shorter length of fabric.

Finally, it will be appreciated that this centering device can also be employed with tubular fabrics not having a missing weft line, where centering can only be carried out consequent to twists being detected as the tubular fabric advances.

While a specific embodiment of the invention has been disclosed, it is to be understood that such disclosure has been merely for the purpose of illustration and that the invention is not to be limited in any manner thereby. Various modifications will be apparent to those skilled in the art in view of the foregoing example. The scope of the invention is to be limited only by the appended claims.

I claim:

1. A device for centering a tubular fabric comprising:

two groups of rollers idly mounted on axes transverse with respect to a given direction of advancement of the fabric;

motor driven roller units for carrying the two groups of rollers;

photoelectric cell means positioned along the path of the tubular fabric and for controlling the motor driven roller units;

cutting means for cutting the fabric lengthwise and being downstream of the photoelectric cell means;

said motor driven roller units being controlled by the photoelectric cell means for moving the two groups of rollers sideways relative to their planes of rotation and rotating the fabric about an axis substantially parallel to said given direction; and stretching means adapted for stretching the tubular fabric transverse to said given direction, said stretching means being connected to said motor driven roller units supporting said groups of rollers.

2. A device according to claim 1, wherein said stretching means includes:

a central fixed supporting portion within the tubular fabric; and a pair of oscillating arms each having an end portion mounted to said central fixed portion, said arms being kept divaricated against the tubular fabric by resiliently yieldable biasing means.

3. A device according to claim 2, wherein each of said motor driven roller units is secured to a free end of one of said oscillating arms.

4. A device according to claim 1, wherein said motor driven roller units each have a corresponding electric motor, said electric motors being adapted for controlling rotation, in the same direction of rotation about respective axes substantially parallel with respect to said given direction, of a respective motor driven supporting member, each of said motor driven supporting members for holding the rollers.

5. A device according to claim 4, wherein the rollers are angularly equally spaced around their respective supporting member.

6. A device according to claim 4, wherein said supporting members are of substantially annular shape.

* * * * *